United States Patent [19]

Yamauchi

[11] Patent Number: 4,547,643

[45] Date of Patent: Oct. 15, 1985

[54] TEMPERATURE SENSING PROBE FOR MICROWAVE OVEN APPLICATION

[75] Inventor: Juichi Yamauchi, Ibaragi, Japan

[73] Assignee: Sharp Kabushiki Kaisha, Osaka, Japan

[21] Appl. No.: 538,903

[22] Filed: Oct. 4, 1983

[30] Foreign Application Priority Data

Oct. 6, 1982 [JP] Japan ..... 57-152699[U]
Oct. 22, 1982 [JP] Japan ..... 57-160501[U]
Oct. 22, 1982 [JP] Japan ..... 57-160502[U]

[51] Int. Cl.[4] ..... H05B 6/64

[52] U.S. Cl. ..... 219/10.55 R; 219/10.55 B; 219/10.55 E; 219/10.55 F

[58] Field of Search ..... 219/10.55 B, 10.55 R, 219/10.55 E, 10.55 F; 339/6 R

[56] References Cited

U.S. PATENT DOCUMENTS 4,149,056 4/1979 Kaneshiro et al. ..... 219/10.55 R

*Primary Examiner*—Roy N. Envall, Jr.
*Assistant Examiner*—Marvin M. Lateef
*Attorney, Agent, or Firm*—Birch, Stewart, Kolasch & Birch

[57] ABSTRACT

A connector of temperature sensing probe for a microwave oven which connects to the control circuit of the microwave to rotate together with a turntable while being inserted in the food being cooked.

A plug which is provided in one end of the temperature sensing probe is inserted along a plug guide into a connector, and is sandwiched by elastic parts composed of first and second springs. When the plug revolves with the rotation of the turntable, the cylinder itself also rotates, cause the lead to output temperature data from the probe via the contact elements. As a result, due to the minimum number of parts used, the connector embodied by the present invention has an extremely compact and simple structure, enabling the temperature sensing probe to freely rotate, thus resulting in a reduced cost for both material and assembly.

7 Claims, 8 Drawing Figures

FIG.5
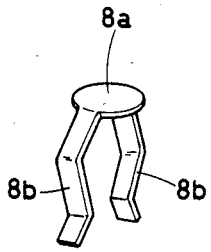
FIG.6
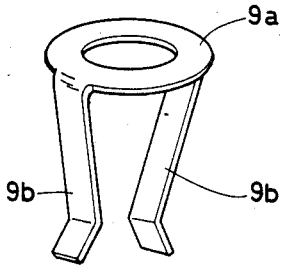
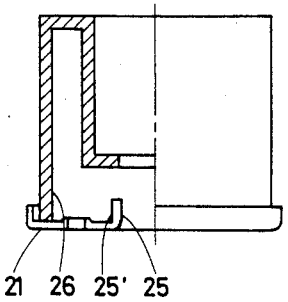
FIG.7

TEMPERATURE SENSING PROBE FOR MICROWAVE OVEN APPLICATION

BACKGROUND AND SUMMARY OF THE INVENTION

The present invention relates to a connector for a temperature sensing probe of a microwave oven, and more particularly, to a device that connects a temperature sensing probe to the control circuit of the microwave oven, wherein said temperature sensing probe is inserted into the food being cooked rotates together with the turntable of the microwave oven.

A typical microwave oven incorporating heat control means that respond varying temperature and which can be monitored during the food cooking operation is already commercially available. Such a microwave oven is designed so that the temperature can be properly controlled, for example, by inserting a temperature sensing probe containing a thermister incorporated in the tip portion of a metal needle tube into the food in order that temperature data detected by the thermister can be sent to the heat source control circuit such as a magnetron of the microwave oven.

On the other hand, while operating a microwave oven that uses a turntable for rotating the food during the cooking operation and the temperature control means mentioned above, the food being cooked rotates together with the temperature sensing probe. This makes it quite necessary that the temperature sensing probe be properly connected to the microwave oven so that it can freely rotate throughout the cooking operation.

As shown in a sectional view in a conventional connector of FIG. 1 and the plane view thereof in FIG. 2, a typical device connected to a freely rotating temperature sensing probe incorporates a structure comprising bushes 2*a* and 2*b* in choke 1 that is secured to the microwave oven unit so that the relay jack 3 is freely rotatably supported by bushes 2*a* and 2*b*. A plug connected to one end of the temperature sensing probe is inserted into the relay jack 3 in order that the plug can rotate together with the relay jack, thus causing the contact elements 4*a* and 4*b* to be elastically placed into contact with guide plates 41 and 42 that are provided at one end of the relay jack 3, and enabling the temperature data to be record. Details of this mechanism were disclosed by U.S. Pat. No. 4,149,056 "MICROWAVE OVEN WITH FOOD TEMPERATURE-SENSING MEANS" to Kaneshiro et al.

With reference to the mechanism of the conventional connector discussed above, not only the guide plates 41 and 42, but also a variety of parts such as a plug hold spring 33', a jack cylinder 44, and many other elements are required for the relay jack 3. In addition, since the connector has a complex structure, it cannot be easily produced. As a result, the cost still remains very high.

In the light of such disadvantages, the present invention is primarily directed to providing a connector that enables a rotating temperature sensing probe to be effectively connected to the connector while at the same time being composed of a simple structure by minimizing the parts being used.

A preferred embodiment of the present invention provides an improved connector of the temperature sensing probe for connection with the control circuit of a microwave oven to permit the probe to freely rotate together with the turntable when it is inserted into food during the cooking operation. More particularly, an improved connector comprises a freely rotating cylinder made of an insulation material, which is installed in a choke secured to the microwave oven unit. The connector contains first and second springs which are made of a conductive material and secured to the cylinder, one end of which makes up a plane surface along one end of the surface of the cylinder. The other end thereof makes up an elastic part along the inner surface of said cylinder, and the first and second contact elements elastically come into contact with the plane surfaces of the first and second springs. A plug at the tip portion of said probe is supported by the elastic parts of both the first and second springs, and as a result, the plug is supported by said choke in a freely rotating state via said cylinder, thereby eventually allowing said contact elements to send out the temperature data detected by the temperature sensing probe.

Another preferred embodiment of the present invention provides means, in which the choke lid secured to the microwave oven unit is made a throttle plate, whereas a cylinder of a large diameter is projectively installed in the center position of said choke lid via an opening which passes through the plug of the temperature sensing probe to enable the choke lid and choke itself to be coupled together. If necessary, a spacer is provided in the choke opening so that the spacer behaves as a guide to enable the plug of said probe to be inserted into said opening.

BRIEF DESCRIPTION OF THE DRAWINGS

The present invention will become better understood from the detailed description given hereinbelow and the accompanying drawings which are given by way of illustration only, and thus are not limitative of the present invention and wherein:

FIGS. 5 and 6 respectively show perspective views of the first and second springs as a preferred embodiment of the present invention.

FIG. 7 is a sectional view of the main part of the connector as another preferred embodiment of the present invention.

DETAILED DESCRIPTION OF THE INVENTION

With reference to the attached drawings, the preferred embodiments of the present invention are described below.

Figure 1:
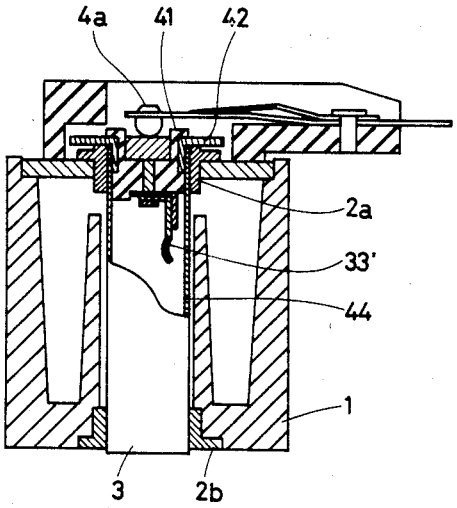
FIG. 1 is a front sectional view of a conventional connector.
Figure 2:
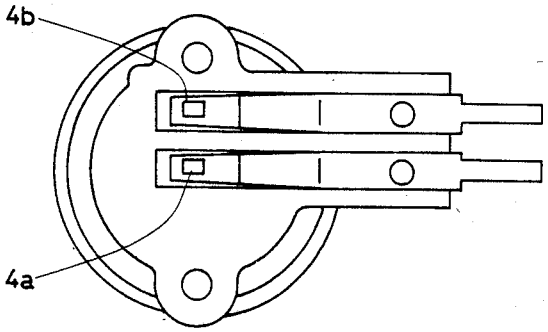
FIG. 2 is a plane view of a conventional connector shown in FIG. 1.
Figure 3:
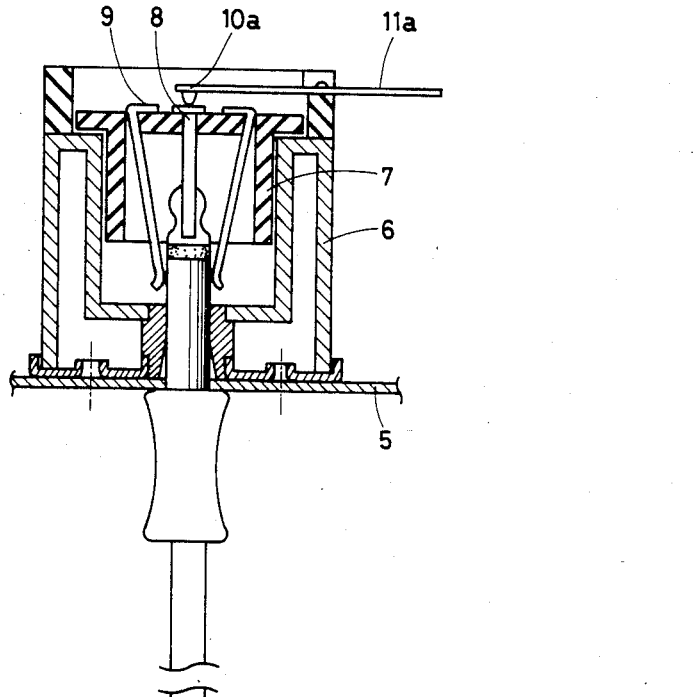
FIG. 3 is a front sectional view of the connector as a preferred embodiment of the present invention.
Figure 4:
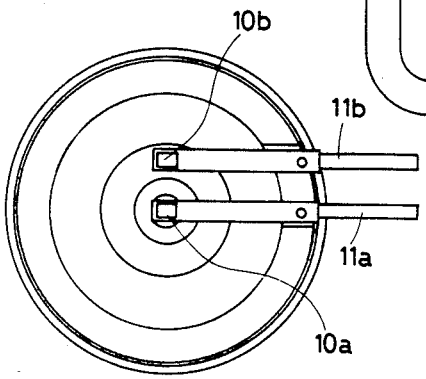
FIG. 4 is a plane view of the connector shown in FIG. 3.

FIG. 3 is a sectional view of the connector as a preferred embodiment of the present invention. FIG. 4 is a plane view of the connector shown in FIG. 3 seen from the upright position.

Choke 6 secured to the microwave oven unit 5 is provided with a cylinder 7 which is made of an insulation material, for example, plastics. The cylinder 7 is securely provided with a first spring 8 and a second spring 9 which are respectively shown in the perspective views of FIGS. 5 and 6. The first spring 8 is composed of a pair of the elastic parts 8*b* and 8*b* protruding from a circular plane part 8*a*. Likewise, the second spring 9 has a pair of elastic parts 9*b* and 9*b* protruding from a circular plane part 9*a*. These elements are unitedly composed of conductive material, for example, a copper alloy, finished with nickel plating.

The first and second springs 8 and 9 are arranged so that their plane parts 8*a* and 9*a* correctly lay on the surface of the cylinder 7, while the elastic parts 8*b* and 9*b* also correctly meet the internal surface of said cylinder. Circular plane parts 8*a* and 9*a* of the first and second springs 8 and 9 are elastically held in contact with the first and second contact elements 10*a* and 10*b*, while leads 11*a* and 11*b* are connected to contact elements 10*a* and 10*b*, respectively. A plug guide 12 is installed to choke 6 on the identical axis to that of the cylinder 7.

When the plug 14 in one end of the temperature sensing probe 13 is inserted along the plug guide into the connector, plug 14 is sandwiched by elastic parts 8*b* and 9*b* of the first and second springs 8 and 9.

When the plug 14 is revolved by the rotation of the turntable, cylinder 7 also rotates so that temperature data from the temperature sensing probe are sent to leads 11*a* and 11*b* via the contact elements 10*a* and 10*b*.

Figure 8:
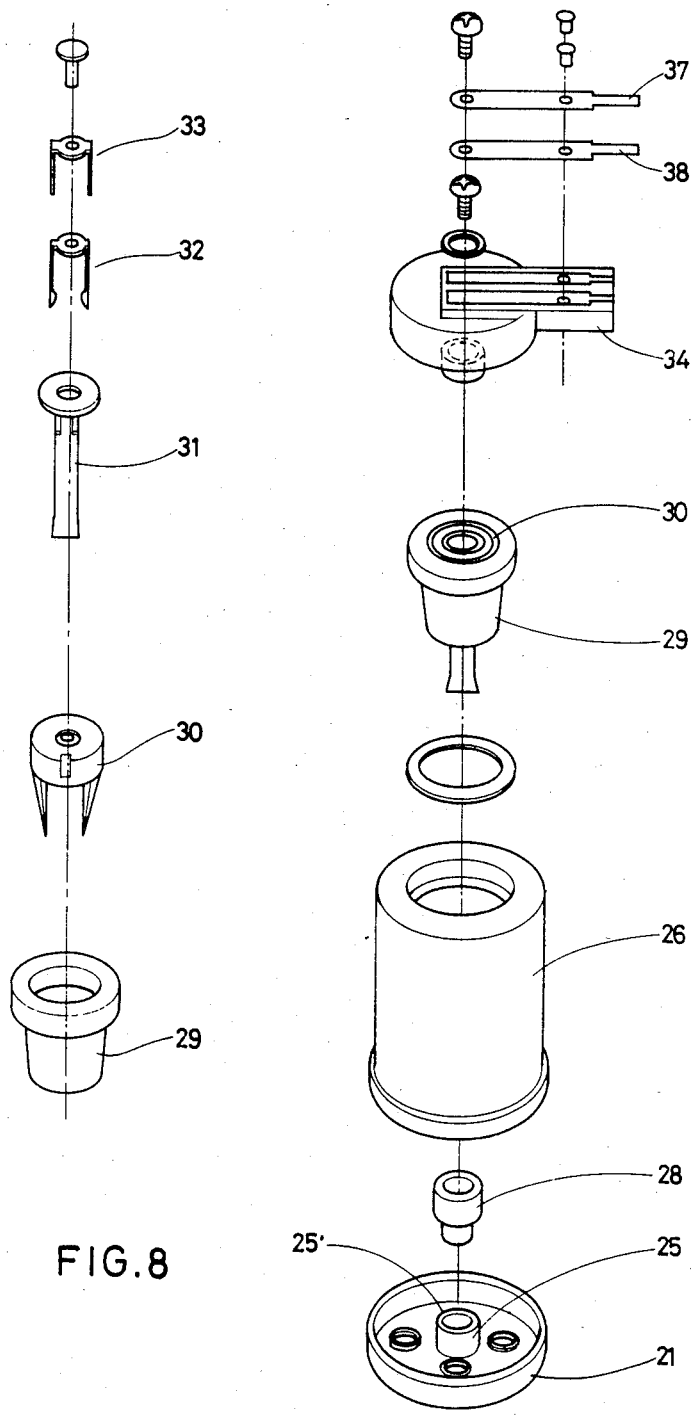
FIG. 8 is an exploded view of the connector shown in FIG. 7.

FIG. 7 shows a sectional view of the main part of a connector according to another preferred embodiment of the present invention, whereas FIG. 8 is an exploded view of the connector shown in FIG. 7. This represents a slipping connector to which an output terminal of the temperature sensing probe 13 that detects temperature of the food being cooked on the turntable of a microwave is connected, while said connector incorporates a circular choke made of throttle metal plate having its structure divided into a bore and outer diameter parts, and yet the bore contains a mobile contact that permits an output terminal to be freely connected or disconnected in the center space of the bore. As a result, since the choke part is made of a throttle metal plate, it is cheaper than a diecast substrate, while the connector can be made up in a compact size, since it contains a mobile contact in the center space of the choke bore.

Referring to FIG. 7, reference numeral 21 is a choke lid secured to wall 22 of the cooking chamber of a microwave oven by screws. Cylinder 25 contains a choke which is about 5 mm high and wider than the circular opening through which a plug 24 of the temperature sensing probe passes, while said cylinder 25 is projectively installed in the center space surrounded by the throttle metal plate. Cylindrical choke 26 is connected to the choke lid 21 by calking, while a choke opening 27 is provided in the upper edge 25' of said cylinder 25. Sliding pipe 28 made of a friction-free resin such as "TEFLON" is in contact with plug 24 which is installed in the opening 27 of said choke.

FIG. 8 is an exploded view of said connector, in which, the first cylindrical rotor 29 being installed to said choke 26 in a free rotational state is internally provided with the second cylindrical rotor 30 that is tightly inserted into and coupled with said first rotor 29. The first elastic part 31 secured to the internal part of the second cylindrical rotor 30 is finished with nickel plating over its surface. The plug 24 is inserted into the connector, and the first elastic part 31 elastically contacts the ground of said plug 24.

Reference number 32 denotes the second elastic part that elastically comes into contact with the tip portion 24' of said plug 24 that transmits signals detected by a thermister (not illustrated) of the temperature sensing probe 23. The second elastic part is made of a nickel-plated phosphorated bronze plate, which is secured to the center position of the first rotor 29 via an auxiliary plate 33. Reference number 34 denotes a terminal base that is secured to the upper surface of the choke 26 by screws, which provides the first contact sheet 35 that is pressed against the upper surface of the first elastic part 31 and the second contact sheet 36 pressed against the upper surface of the second elastic part 32, while said contact sheets 35 and 36 are respectively connected to the control circuit of the microwave oven unit, to which temperature data of the food detected by the thermister is transmitted.

The effect of arranging a cylinder 25 of about 5 mm in height in the center position of the choke lid 21, which is secured to wall 22 of the cooking chamber by screws with said cylinder tightly inserted into the choke 6 results in an attenuation which is as effective as the case in which the choke inlet is moved away from the inner part even if the choke opening 27 of the choke 26 is provided in a lower position, proving that it is an advantageous choke structure.

As a result, screwing holes can be provided through the wall of the cooking chamber to permit the connector to be properly secured with screws at a position where the choke effect near the choke inlet is rarely affected, thus allowing the connector to be securely installed.

Another preferred embodiment of the present invention is characterized by the simplified method of installing both the choke lid and choke as a result of the connection of the choke lid and choke by making up said lid with a metal throttle plate secured to the microwave oven and by projectively installing a cylinder having a greater diameter than the opening which permits the plug of the temperature sensing probe to enter into the center position of the choke lid. This embodiment is also characterized by effectively preventing microwave leakage because the projectively installed cylinder ensures a satisfactory choke effect, even if the choke opening is internally provided, i.e., in a position adjacent to the cooking chamber. It provides a still further advantage in that the choke unit can be securely installed to the microwave oven, since screw holes can be provided in such portions where the choke effect near the choke inlet is rarely affected. Since the above preferred embodiment provides the choke opening of the choke near the wall of the cooking chamber and a spacer that guides the plug of the temperature sensing probe to correctly enter the choke opening, the connection parts such as contact sheets that respectively come into contact with the plug of the temperature sensing probe at a position apart from the cooking chamber wall and the lead terminals to be connected to the control circuit of the microwave oven can be compactly arranged, thus enabling the connecter to be built in a very compact size.

As clear from the above detailed description, the preferred embodiments of the present invention typically provide simple structures of connectors by minimizing the parts required, thus allowing the temperature sensing probe to be properly connected in a free rotational state and eventually minimizing the cost needed for the materials and assembly as well.

The present invention thus described in reference to the annexed drawings will obviously be suggestive of any derivation or modification from the spirit and scope contained therein by those skilled in the arts. It should be understood, however, that the present invention is not limitative within the spirit and scope described therein, but is intended to solely include all of such derivations and/or modifications within the spirit and scope of the following claims.

What is claimed is:

1. A connector for connecting a temperature sensing probe to the control circuit of a microwave oven comprising;

a choke attached to the microwave oven, a cylinder made of an insulating material rotatably disposed in said choke, first and second spring bias means operatively connected to said cylinder, with one end of each forming a conducting plane surface that meets the surface of one end portion of said cylinder, the other ends thereof extending into said cylinder, first and second contact elements elastically contacting the plane surfaces of said first and second spring means, and a temperature sensing probe provided at one end thereof with a plug which is held by the spring bias of said first and second spring means, whereby said plug which is held within said choke by said cylinder is free to rotate with said cylinder, so that the temperature data detected by the temperature sensing probe can be output from the contact elements.

2. The connector according to claim 1 wherein the choke is provided with a lid made of throttle metal plate secured to the microwave oven, and a cylinder having a greater diameter than the opening for allowing entry of the plug of said probe is projectively installed in the center position of the choke lid so that said choke lid and said choke are connected together.

3. The connector according to claim 1 wherein the choke opening of the choke is provided with a choke lid which is secured to the microwave oven near the wall of the cooking chamber and a spacer is provided for guiding the entry of the plug into an opening of said choke.

4. A connector for connecting a temperature sensing probe to the control circuit of a microwave oven comprising a choke adapted to be attached to a microwave oven, an insulating member rotatably disposed within said choke, and first and second spring members operatively connected with said insulating member, one end portion of said spring members defining a conductive plane surface and the other end portion of said spring members extending into said insulating member, said other end portion of said first and second spring members being spring biased for separate contact with different portions of said temperature sensing probe.

5. The connector of claim 4 wherein the insulating member has a cylindrical shape and the other end portion of the first and second spring members has leg elements which extend into the insulating member and are spring biased toward each other for elastic attachment to a portion of the temperature sensing probe.

6. The connector of claim 4 wherein one end portion of the first spring member has a flat circular configuration and the other end portion thereof has at least two leg elements which are spring biased toward each other, and the one end portion of the second spring member has a flat donut configuration and the other end portion thereof has at least two leg elements which are spring biased toward each other, wherein the end portion of the first spring members is concentrically disposed within the donut shaped end portion of the second spring member defining a continuous, substantially flat surface with separate electrical contact areas.

7. The connector of claim 6 wherein the legs of the respective first and second spring members extend to different levels for separate contact with different portions of the temperature probe.

* * * * *